US007798618B2

(12) United States Patent
Katayama

(10) Patent No.: US 7,798,618 B2
(45) Date of Patent: Sep. 21, 2010

(54) INK JET HEAD

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 994 days.

(21) Appl. No.: 11/425,215

(22) Filed: Jun. 20, 2006

(65) Prior Publication Data

US 2006/0284940 A1 Dec. 21, 2006

(30) Foreign Application Priority Data

Jun. 20, 2005 (JP) ..... 2005-179416

(51) Int. Cl.
*B41J 2/045* (2006.01)

(52) U.S. Cl. ..... 347/72

(58) Field of Classification Search ..... 347/68, 347/70–72

See application file for complete search history.

(56) References Cited

U.S. PATENT DOCUMENTS

| | | | |
|---|---|---|---|
| 6,672,715 | B2 | 1/2004 | Isono et al. |
| 2002/0196315 | A1 | 12/2002 | Isono |
| 2003/0156167 | A1 | 8/2003 | Sakaida |
| 2004/0218018 | A1 | 11/2004 | Sakaida |
| 2005/0185028 | A1 | 8/2005 | Sakaida |
| 2006/0125878 | A1 | 6/2006 | Watanabe |
| 2006/0284939 | A1 | 12/2006 | Katayama |

FOREIGN PATENT DOCUMENTS

| | | | |
|---|---|---|---|
| EP | 0925923 | A1 | 6/1999 |
| EP | 1336494 | A1 * | 8/2003 |
| EP | 1338421 | A2 | 8/2003 |
| EP | 1372199 | A1 | 12/2003 |
| EP | 1393906 | A1 | 3/2004 |
| JP | 61-79669 | A | 4/1986 |
| JP | 2001-309672 | * | 11/2001 |
| JP | 2001-309672 | A | 11/2001 |

(Continued)

OTHER PUBLICATIONS

European Search Report Mailed Mar. 17, 2006, in European Patent Application No. 05027105.5.

(Continued)

*Primary Examiner*—An H Do
(74) *Attorney, Agent, or Firm*—Baker Botts L.L.P.

(57) ABSTRACT

An ink jet head is provided with a passage unit and an actuator unit. The passage unit includes a nozzle and a pressure chamber communicating with the nozzle. The actuator unit includes a piezoelectric layer, a first electrode connected with a front surface of the piezoelectric layer, a second electrode connected with a back surface of the piezoelectric layer, a first insulating layer located between the second electrode and the passage unit, and a first conductive member. The first insulating layer includes a first through hole. At least a part of the first conductive member is located in the first through hole. The passage unit includes a concave portion located at a position facing the first through hole, and a protruding portion which protrudes from an inner surface of the concave portion. One end of the first conductive member is electrically connected with the second electrode. The other end of the first conductive member makes contact with the protruding portion.

21 Claims, 13 Drawing Sheets

FOREIGN PATENT DOCUMENTS

JP 2003-53982 A 2/2003

OTHER PUBLICATIONS

European Search Report Mailed Dec. 6, 2006 in European Patent Application No. 06012513.5.
Office Action Mailed Sep. 24, 2008, in Japanese Patent Application No. 2005-179415.
U.S. Patent and Trademark Office, Office Action in co-pending U.S. Appl. No. 11/425,199, Notification Date Apr. 17, 2009.
Chinese Office Action issued in corresponding Chinese Application No. 2006-10093815.4, dated Feb. 15, 2008.
Chinese Office Action issued in corresponding Chinese Application No. 2006-10093814.X, dated Feb. 15, 2008.
European Patent Office, European Search Report for Related EP Application No. 06012514 dated Sep. 25, 2006.

* cited by examiner

INK JET HEAD

CROSS-REFERENCE TO RELATED APPLICATION

This application claims priority to Japanese Patent Application No. 2005-179416, filed on Jun. 20, 2005, the contents of which are hereby incorporated by reference into the present application.

BACKGROUND OF THE INVENTION

1. Field of the Invention

The present invention relates to an ink jet head. The ink jet head is utilized in a device that prints words, images, etc. by discharging ink toward a print medium. The ink jet head is utilized in, for example, an ink jet printer, a copier, a fax machine, a multifunctional product, etc.

2. Description of the Related Art

A normal ink jet head comprises a passage unit and an actuator unit. The passage unit comprises a nozzle and a pressure chamber. The nozzle discharges ink toward a print medium. The pressure chamber is filled with ink. The pressure chamber communicates with the nozzle.

The actuator unit may be stacked on the passage unit. The actuator unit may be a type having a piezoelectric element. The piezoelectric element may include a piezoelectric layer, a first electrode connected with a front surface of the piezoelectric layer, a second electrode connected with a back surface of the piezoelectric layer, and an intermediate layer located between the second electrode and the passage unit. The piezoelectric layer contracts in a planar direction when a potential difference is applied between the first electrode and the second electrode. The first electrode, the second electrode, and the intermediate layer are unable to contract in the planar direction. As a result, the force for causing the piezoelectric layer to contract in the planar direction is transformed into a force for deforming the entire piezoelectric element in a direction of thickness. The piezoelectric element is deformed toward the pressure chamber by applying potential difference between the first electrode and the second electrode. When the piezoelectric element deforms towards the pressure chamber, the volume of the pressure chamber decreases. The pressure of the ink within the pressure chamber is increased, and the ink is discharged from the nozzle. When the potential difference between the first electrode and the second electrode is cancelled, the state in which the piezoelectric element is deformed towards the pressure chamber is released. The volume of the pressure chamber consequently increases, and ink is drawn into the pressure chamber from an ink chamber.

When the intermediate layer is present between the second electrode and the passage unit, the entire piezoelectric element deforms by a greater amount in the direction of thickness. An insulating layer is usually utilized in this intermediate layer. By using this configuration, the pressure within the pressure chamber can be increased and decreased efficiently. An ink jet head having the above configuration is taught in, for example, U.S. Pat. No. 6,672,715.

When, for example, a print medium (printing paper for example) is charged, an electric charge may move from the print medium to the passage unit. The passage unit is thus charged, and the potential of the passage unit may become greater than the potential of the second electrode. In this case, components of the ink (such as hydrogen ions) within the passage unit may be attracted toward the actuator unit (the second electrode), and may penetrate into the actuator unit. When, for example, hydrogen ions have penetrated the actuator unit, hydrogen gas may be formed within the actuator. When hydrogen gas is formed within the actuator unit, the layers within the actuator unit (for example the piezoelectric layer and the second electrode) may peel off.

In the conventional technique (U.S. Pat. No. 6,672,715), the second electrode is exposed at a side surface of the actuator unit. A conductive adhesive is applied across a front surface of the passage unit from the exposed part of the second electrode. The second electrode and the passage unit are thus electrically connected, and the second electrode and the passage unit therefore maintain an approximately identical potential. The components of the ink within the passage unit can thus be prevented from penetrating into the actuator unit.

BRIEF SUMMARY OF THE INVENTION

In the present specification, a second electrode and a passage unit are electrically connected by using a configuration that is completely different from the conventional technique. When this configuration is used, the electrical connection between the second electrode and the passage unit may be more reliable than with the conventional technique.

An ink jet head of the present invention comprises a passage unit and an actuator unit. The actuator unit comprises a first insulating layer located between a second electrode and the passage unit. The first insulating layer comprises a first through hole. The actuator unit further comprises a first conductive member. At least a part of the first conductive member is located in the first through hole. The passage unit comprises a concave portion located at a position facing the first through hole, and a protruding portion which protrudes from an inner surface of the concave portion. One end of the first conductive member is electrically connected with the second electrode. The other end of the first conductive member makes contact with the protruding portion.

The present inventors ascertained by means of research that the first conductive member and the passage unit have a stable electrical connection with this configuration. In this configuration, the electrical connection between the second electrode and the passage unit should be more reliable than with the conventional technique.

BRIEF DESCRIPTION OF THE DRAWINGS

FIG. 8 (*b*) shows a plan view of a part of the actuator unit.

DETAILED DESCRIPTION OF THE INVENTION

First Embodiment

Figure 1:
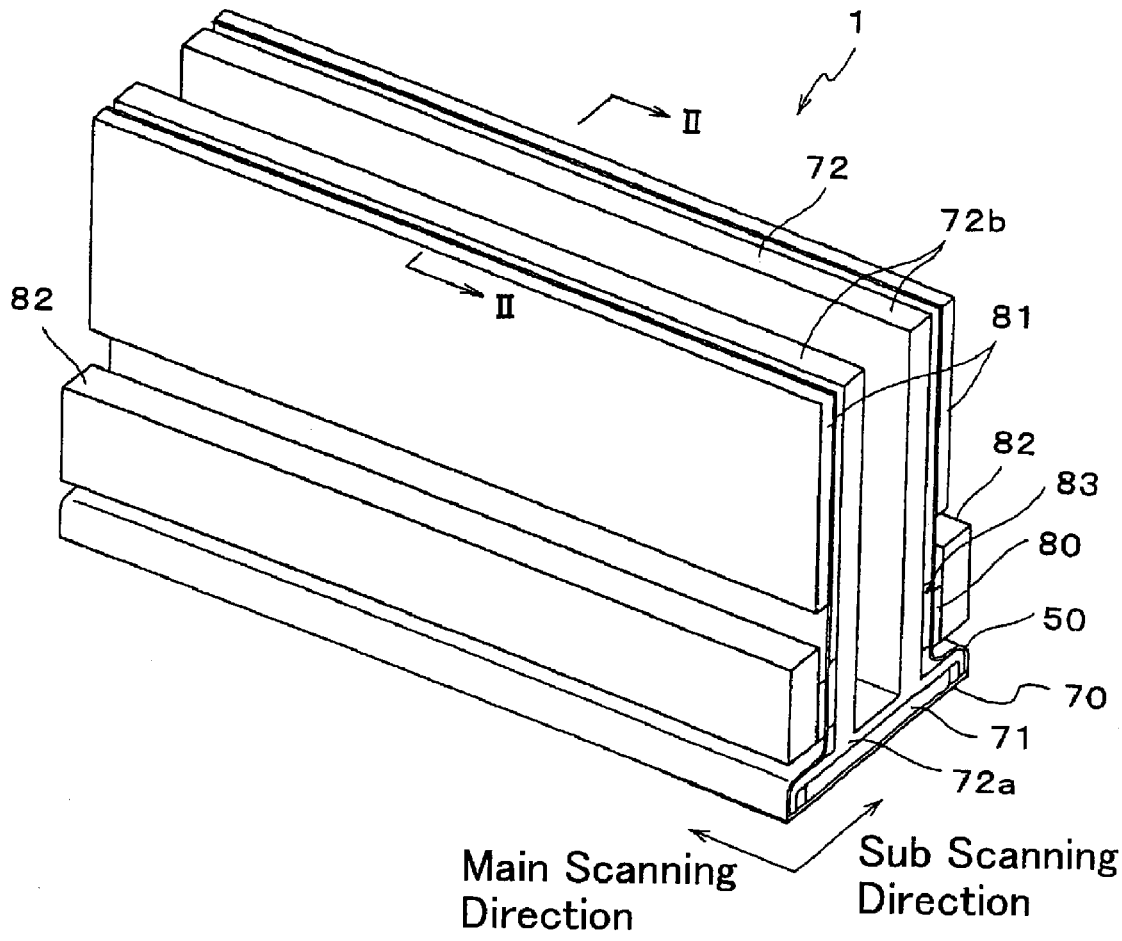
FIG. 1 shows a perspective view of an ink jet head of a first embodiment.

An embodiment of the present invention will now be described with reference to the drawings. FIG. 1 shows a perspective view of an ink jet head 1. The ink jet head 1 is utilized while mounted on an ink jet printer.

The ink jet head 1 comprises a head main body 70, a base block 71, a holder 72, etc. The head main body 70 has a rectangular shape that extends in a main scanning direction. The base block 71 is disposed on an upper surface of the head main body 70. An ink reservoir 3 (to be described: see FIG. 2) is formed in the base block 71. The holder 72 supports the head main body 70 and the base block 71.

Figure 2:
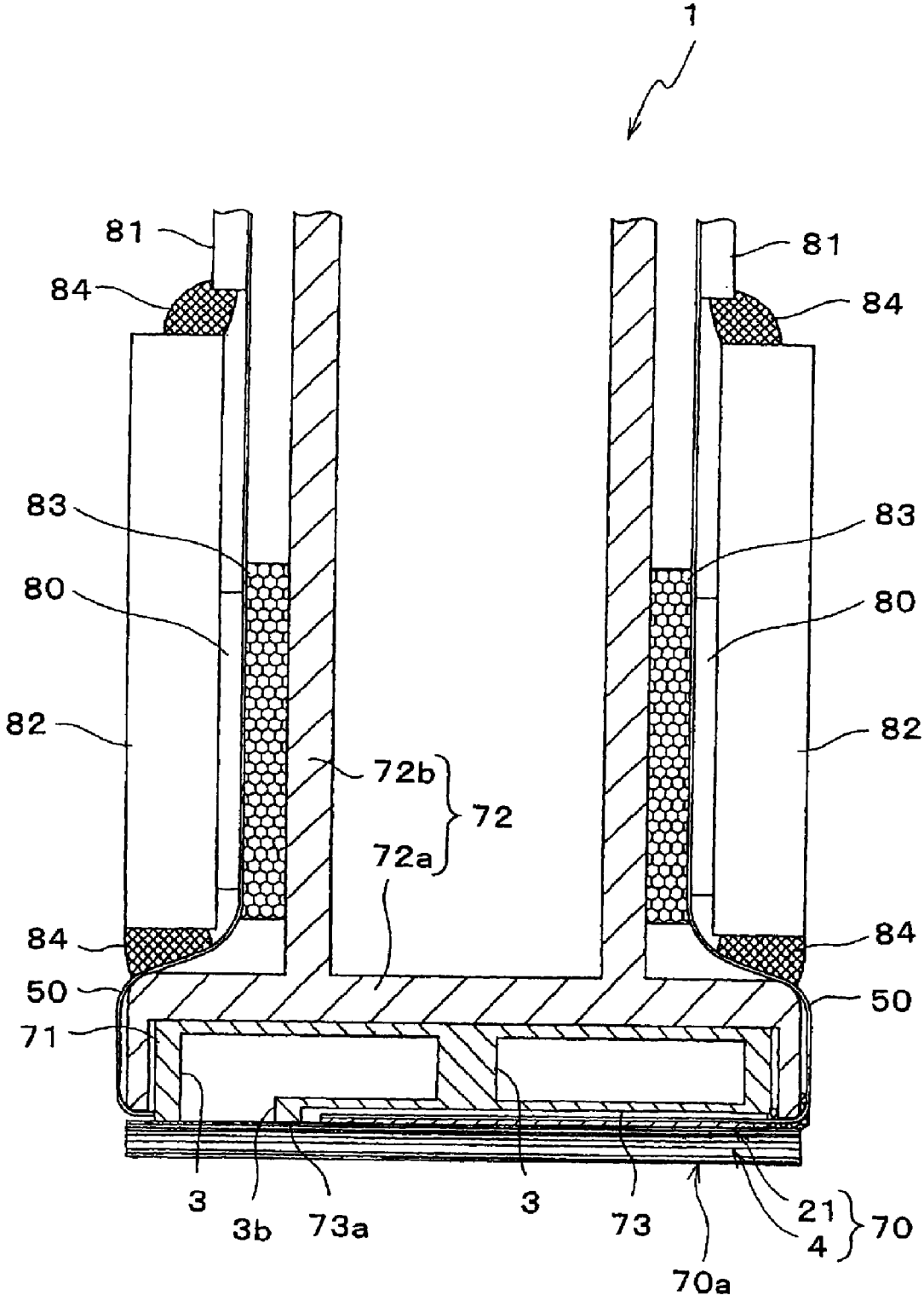
FIG. 2 shows a cross-sectional view along the line II-II of FIG. 1.

FIG. 2 shows a cross-sectional view along the line II-II of FIG. 1. The head main body 70 includes a passage unit 4 and an actuator unit 21 stacked on the passage unit 4. The passage unit 4 has a configuration in which a plurality of thin plates is stacked. An ink passage is formed in the passage unit 4. A plurality of nozzles 8 (see FIG. 6) with an extremely small diameter is disposed in a bottom surface 70*a* of the passage unit 4. Ink is discharged downwards from the bottom surface 70*a* of the passage unit 4.

The actuator unit 21 also has a configuration in which a plurality of thin plates is stacked. The actuator unit 21 is connected with an upper surface of the passage unit 4 by a conductive adhesion layer 6 (to be described: see FIG. 6). In the present embodiment, a plurality of actuator units 21 is connected with the passage unit 4. A flexible printed circuit (FPC) 50 is soldered to an upper surface of the actuator unit 21. The FPC 50 is led to a side (the left or the right in FIG. 2) of the ink jet head 1.

Figure 3:
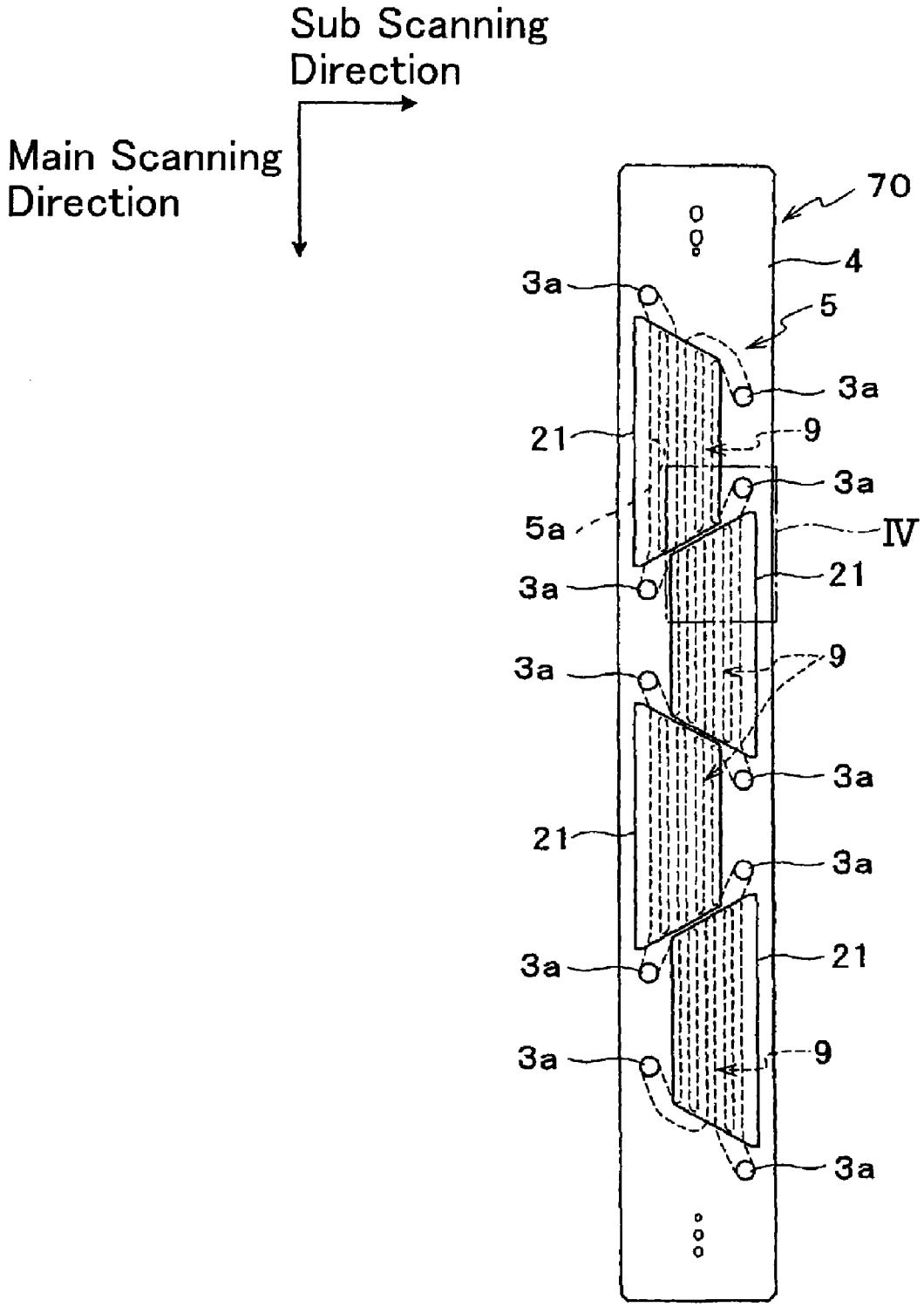
FIG. 3 shows a plan view of a head main body.

FIG. 3 shows a plan view of the head main body 70 (viewed from the opposite side from the bottom surface 70*a*). The passage unit 4 has a rectangular shape that extends in the main scanning direction. A manifold passage 5 is formed within the passage unit 4. The manifold passage 5 is shown by a broken line. The manifold passage 5 functions as a common ink chamber. The manifold passage 5 has a plurality of sub manifold passages 5*a* that extends in a parallel manner in the main scanning direction of the passage unit 4.

Ten openings 3*a* are formed in the upper surface of the passage unit 4 (the surface connected with the actuator unit 21). Five of the openings 3*a* are aligned in the main scanning direction along a right edge of the passage unit 4. The other five of the openings 3*a* are aligned in the main scanning direction along a left edge of the passage unit 4. The ink of the ink reservoir 3 of the base block 71 is led into the manifold passage 5 through the openings 3*a*.

Four actuator units 21 are disposed in a staggered pattern in positions that do not interfere with the openings 3*a* of the passage unit 4. Each of the actuator units 21 has a trapezoid shape when viewed from a plan view. The actuator units 21 are disposed so that a long edge and a short edge thereof extend along the main scanning direction. Two adjacent actuator units 21 overlap in the main scanning direction and the sub scanning direction.

A more detailed description of the configuration of the head main body 70 will be described later.

Returning to FIG. 2, the configuration of the base block 71 will be described. The base block 71 is formed from metal. The base block 71 is formed from, for example, stainless steel. The ink reservoir 3 within the base block 71 extends in the main scanning direction (a direction perpendicular to the page of FIG. 2). An inlet hole (not shown) is formed in one end of the reservoir 3. The inlet hole is connected with an ink tank (not shown: for example an ink cartridge). The ink of the ink tank is led into the ink reservoir 3 via the inlet hole.

The ink reservoir 3 has an outlet hole 3*b*. Although only one outlet hole 3*b* has been shown in FIG. 2, ten outlet holes 3*b* are actually formed. The outlet holes 3*b* are formed in positions corresponding with the openings 3*a* of the passage unit 4. The ink of the ink reservoir 3 is led into the manifold passage 5 via the outlet holes 3*b* and the openings 3*a* of the passage unit 4.

In the base block 71, neighboring portions 73*a* of the outlet holes 3*b* protrude downwards. Only these protruding portions 73*a* make contact with the upper surface of the passage unit 4. That is, there is a space between the upper surface of the passage unit 4 and the portion of the base block 71 other than the protruding portions 73*a*. The actuator unit 21 is disposed in this space.

Next, the configuration of the holder 72 will be described. The holder 72 includes a grip portion 72*a* that grips the base block 71, and a pair of protruding parts 72*b* that protrude upwards from an upper surface of the grip portion 72*a*.

The grip portion 72*a* has a concave part that opens downwards. The base block 71 is fixed within this concave part by means of adhesive.

The pair of protruding parts 72*b* is aligned in the sub scanning direction (the left-right direction of FIG. 2) with a space therebetween. The FPC 50 connected with the actuator unit 21 extends upwards along the protruding parts 72*b*. A resilient member 83 (a sponge, for example) is disposed between one surface of the FPC 50 and the protruding parts 72*b*. A driver IC 80 is connected with the other surface of the FPC 50. The actuator unit 21 and the driver IC 80 are electrically connected via the FPC 50. The FPC 50 transmits driving signals output from the driver IC 80 to the actuator unit 21.

A heat sink 82 that has a substantially rectangular parallelopiped shape makes contact with the driver IC 80. The heat sink 82 allows heat generated by the driver IC 80 to escape. A base 81 is disposed above the heat sink 82, and is fixed to one end of the FPC 50. A sealing member 84 is disposed between the base 81 and an upper end of the heat sink 82. A sealing member 84 is also disposed between a lower end of the heat sink 82 and the FPC 50. These sealing members 84 can prevent refuse or ink from entering within the ink jet head 1.

Figure 4:
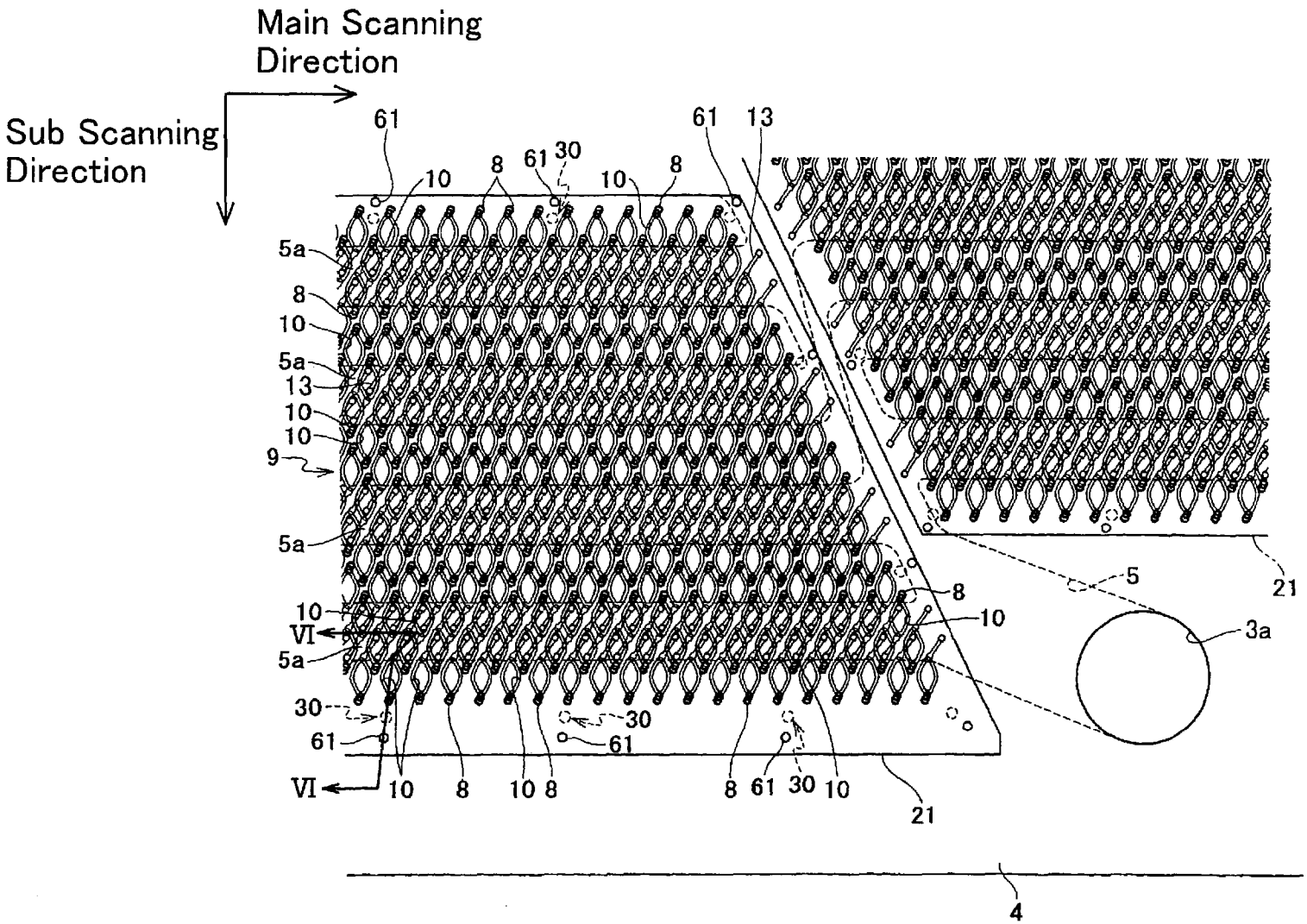
FIG. 4 shows an expanded view of a region IV of FIG. 3.

Next, the configuration of the head main body 70 will be described in detail with reference to FIG. 4. FIG. 4 shows an expanded view of a region IV of FIG. 3. In FIG. 4, nozzles 8, pressure chambers 10, and apertures 13 that cannot actually be seen are shown by solid lines.

As described above, a plurality of sub manifold passages 5*a* is formed in the passage unit 4. Four sub manifold passages 5*a* correspond to one actuator unit 21. The four sub manifold passages 5*a* extend in a parallel manner in the main scanning direction. A plurality of ink passages 7 (see FIG. 6), which communicates with a plurality of nozzles 8, is connected with the sub manifold passages 5*a*.

The passage unit 4 has a plurality of pressure chambers 10 and a plurality of nozzles 8. The pressure chambers 10 are disposed in a matrix shape. From a plan view, each pressure chamber 10 is substantially diamond shaped. One longer diagonal edge of each pressure chamber 10 communicates with one nozzle 8. The other longer diagonal edge of each pressure chamber 10 communicates with one aperture 13. The aperture 13 communicates with the sub manifold passage 5*a*. Below, a plurality of pressure chambers 10 that corresponds to one actuator unit 21 will be termed a pressure chamber group 9. One actuator unit 21 overlaps with all the pressure chambers 10 of the pressure chamber group 9.

The plurality of nozzles 8 opens into the bottom surface 70*a* of the passage unit 4 (see FIG. 2). Like the pressure chamber group 9, the nozzles 8 are disposed in a matrix shape.

Figure 5:
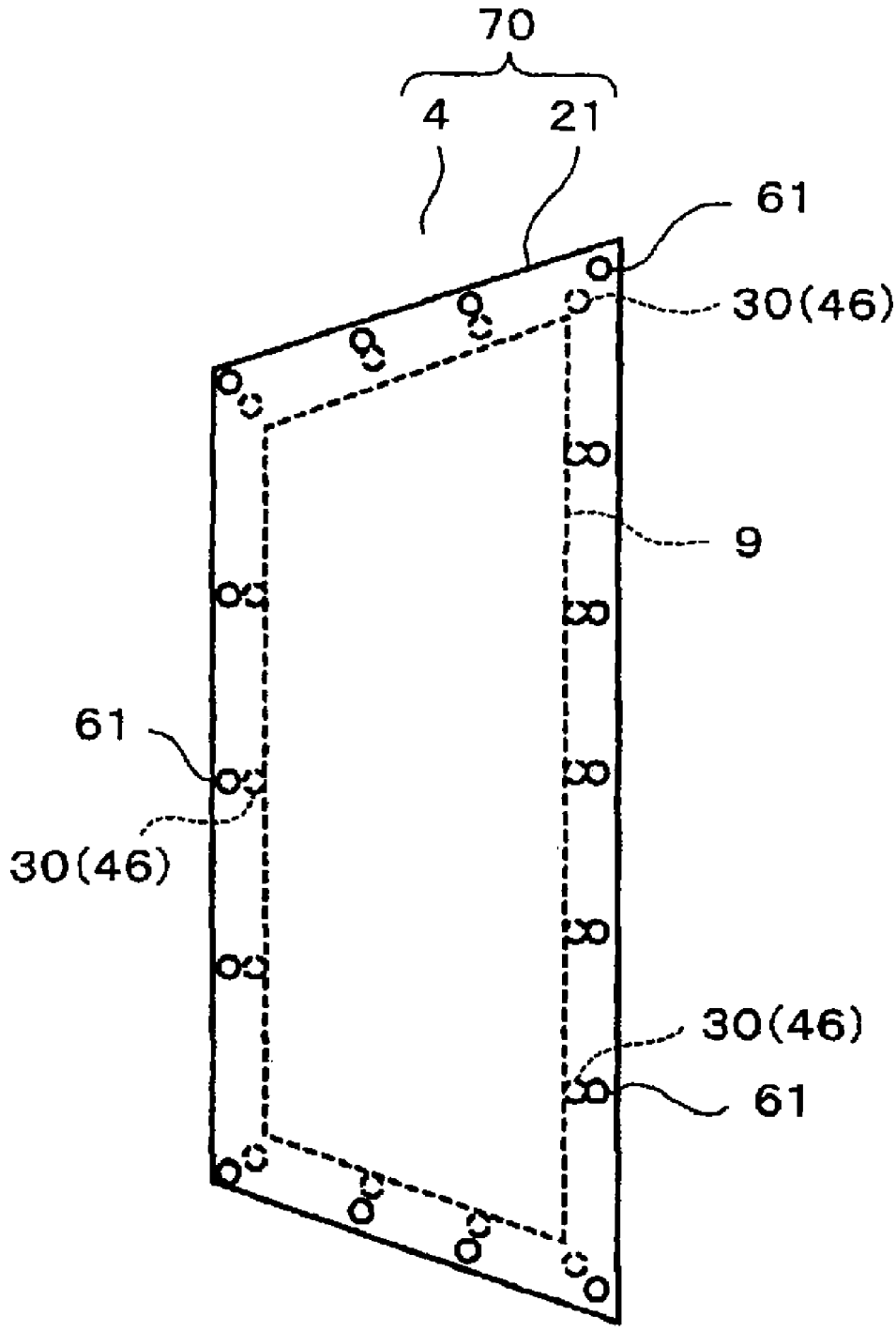
FIG. 5 shows a plan view of one actuator unit.

FIG. 5 shows a plan view of one actuator unit 21. Each of the pressure chambers 10 is not shown in FIG. 5, and the region in which the pressure chamber group 9 is formed is shown by a broken line.

Although this will be described in detail later, a plurality of concave portions 30 (see FIG. 6) is formed in the upper surface of the passage unit 4. The concave portions 30 are formed at approximately equal intervals. The pressure chamber group 9 is surrounded by the concave portions 30. From a plan view, each concave portion 30 is circular (in more detail; ring shape).

Furthermore, a plurality of surface electrodes 61 is formed at the upper surface of the actuator unit 21. Each surface electrode 61 corresponds to one concave portion 30. The surface electrodes 61 are formed outwards from the concave portions 30. That is, from a plan view, the surface electrodes 61 and the concave portions 30 are offset.

Figure 6:
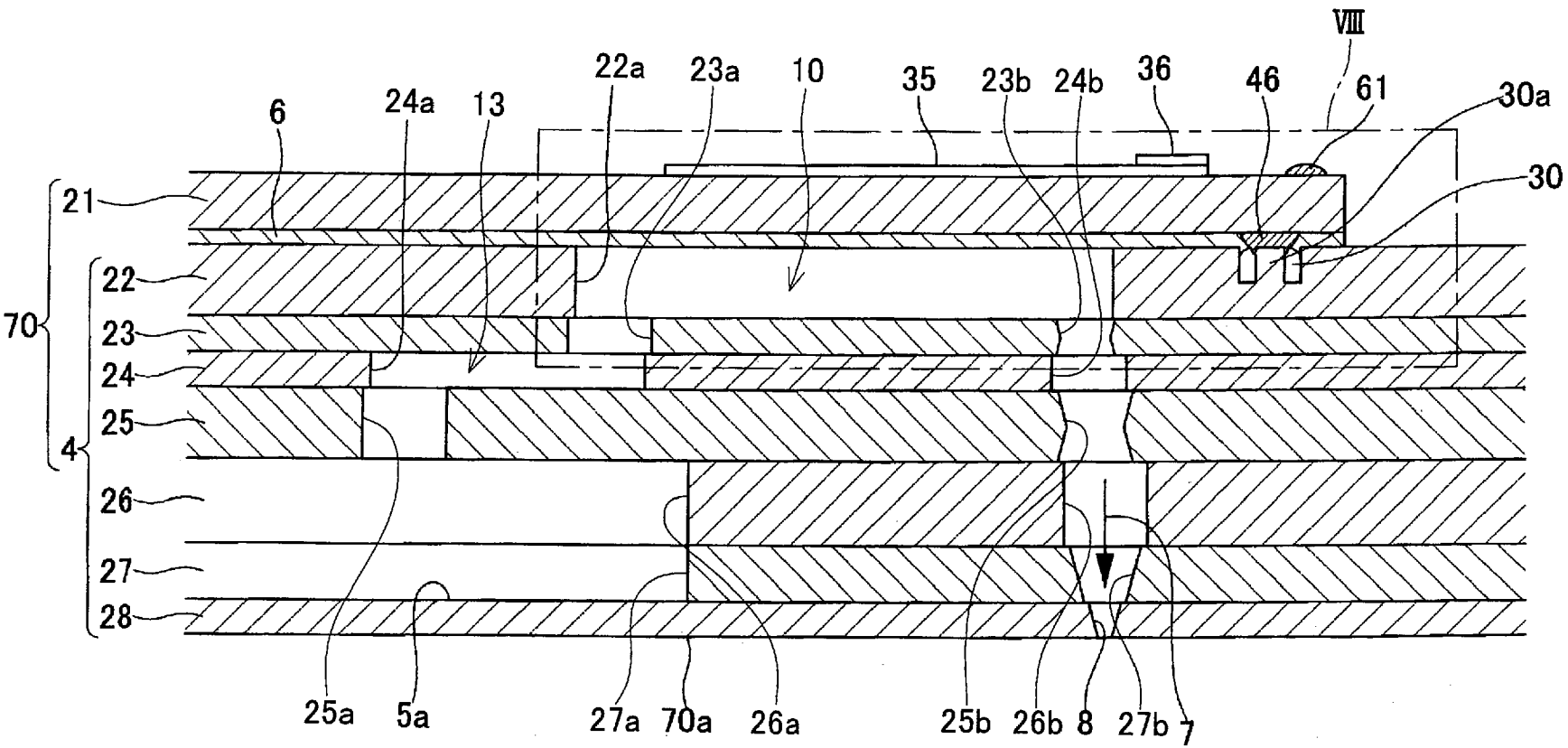
FIG. 6 shows a cross-sectional view along the line VI-VI of FIG. 4.

FIG. 6 shows a cross-sectional view along the line VI-VI of FIG. 4. The passage unit 4 has a cavity plate 22, a base plate 23, an aperture plate 24, a supply plate 25, two manifold plates 26 and 27, and a nozzle plate 28. The plates 22 to 28 are formed from metal (for example, from stainless steel). However, the nozzle plate 28 may be formed from resin.

The cavity plate 22 has a long hole 22*a*. The long hole 22*a* functions as the pressure chamber 10. Further, the concave portion 30 is formed in an upper surface of the cavity plate 22. The concave portion 30 opens upward (toward the actuator unit 21). A protruding portion 30*a* extending upwards is formed at a bottom surface of the concave portion 30. In FIG. 6 only one long hole 22*a* and one concave portion 30 have been shown. However, a plurality of long holes 22*a* and a plurality of concave portions 30 are formed in the cavity plate 22. The protruding portion 30*a* is formed at each concave portion 30.

The base plate 23 has holes 23*a* and holes 23*b*. Each hole 23*a* corresponds to different one pressure chamber 10. Each hole 23*b* corresponds to different one pressure chamber 10. Each hole 23*a* is formed at a position facing one edge of a corresponding pressure chamber 10. Each hole 23*b* is formed at a position facing the other edge of a corresponding pressure chamber 10.

The aperture plate 24 has long holes 24*a* and holes 24*b*. The long holes 24*a* function as the apertures 13. Each long hole 24*a* corresponds to different one hole 23*a* of the base plate 23. Each hole 24*b* corresponds to different one hole 23*b* of the base plate 23. One end of each long hole 24*a* is disposed at a position facing a corresponding hole 23*a* of the base plate 23. Each hole 24*b* is disposed at a position facing a corresponding hole 23*b* of the base plate 23.

The supply plate 25 has holes 25*a* and 25*b*. Each hole 25*a* corresponds to different one long hole 24*a* of the aperture plate 24. Each hole 25*b* corresponds to different one hole 24*b* of the aperture plate 24. Each hole 25*a* is disposed at a position facing the other end of a corresponding long hole 24*a* of the aperture plate 24. Each hole 25*b* is disposed at a position facing a corresponding hole 24*b* of the aperture plate 24.

The first manifold plate 26 has a long hole 26*a* and holes 26*b*. The long hole 26*a* functions as the sub manifold passage 5*a*. The holes 25*a* of the supply plate 25 communicate with the long hole 26*a*. Each hole 26*b* corresponds to different one hole 25*b* of the supply plate. Each hole 26*b* is disposed at a position facing a corresponding hole 25*b* of the supply plate 25.

The other manifold plate 27 also has a long hole 27*a* and holes 27*b*. The long hole 27*a* has the same shape as the long hole 26*a* of the manifold plate 26. The long hole 27*a* functions as the sub manifold passage 5*a*. Each hole 27*b* corresponds to different one hole 26*b* of the manifold plate 26. Each hole 27*b* is disposed at a position facing a corresponding hole 26*b* of the manifold plate 26.

The nozzle plate 28 has the nozzles 8. Each nozzle 8 corresponds to different one hole 27*b* of the manifold plate 27. Each nozzle 8 is disposed at a position facing a corresponding hole 27*b* of the manifold plate 27.

The sub manifold passages 5*a* communicate with the nozzles 8 via the apertures 13 and the pressure chambers 10. That is, the ink passages 7 that extend from the sub manifold passages 5*a* to the nozzles 8 via the apertures 13 and the pressure chambers 10 are formed in the passage unit 4. One ink passage 7 is formed for each of the pressure chambers 10.

One ink passage 7 is provided with two passages that have the pressure chamber 10 in the center thereof. The first passage extends from an upper end of the sub manifold passage 5*a* to one edge (at the left side in FIG. 6) of the pressure chamber 10 via the aperture 13. The other passage extends from the other edge (at the right side in FIG. 6) of the pressure chamber 10 to the nozzle 8.

The reference number 6 in FIG. 6 refers to the conductive adhesion layer. The conductive adhesion layer 6 is formed between a front surface (the upper surface in FIG. 6) of the cavity plate 22 of the passage unit 4 and a back surface (the lower surface in FIG. 6) of the actuator unit 21. The passage unit 4 and the actuator unit 21 are bonded together by means of the conductive adhesion layer 6.

Figure 7:
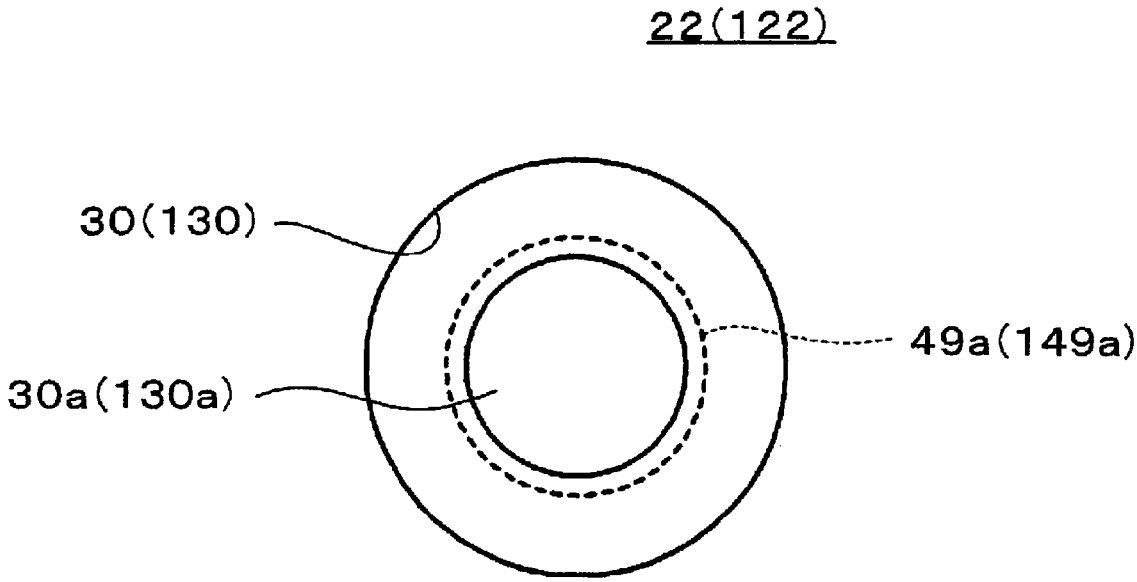
FIG. 7 shows a plan view of a concave portion.

FIG. 7 shows a plan view of one concave portion 30. A protruding portion 30*a* is formed at a bottom surface of the concave portion 30, and the concave portion 30 is formed in a ring shape. From a plan view, the center of the concave portion 30 is in the same position as the center of the protruding portion 30*a*. Further, the depth of the concave portion 30 is equal to the height of the protruding portion 30*a*. That is, an upper surface of the protruding portion 30*a* and an upper surface of the passage unit 4 are located on the same plane. This can be seen clearly in FIG. 6.

A reference number 49*a* in FIG. 7 refers to a through hole formed in a piezoelectric sheet 43 (to be described). As is clear from FIG. 7, the diameter of the concave portion 30 is greater than the diameter of the through hole 49*a*. Further, the diameter of the protruding portion 30*a* is smaller than the diameter of the through hole 49*a*.

Figure 8:
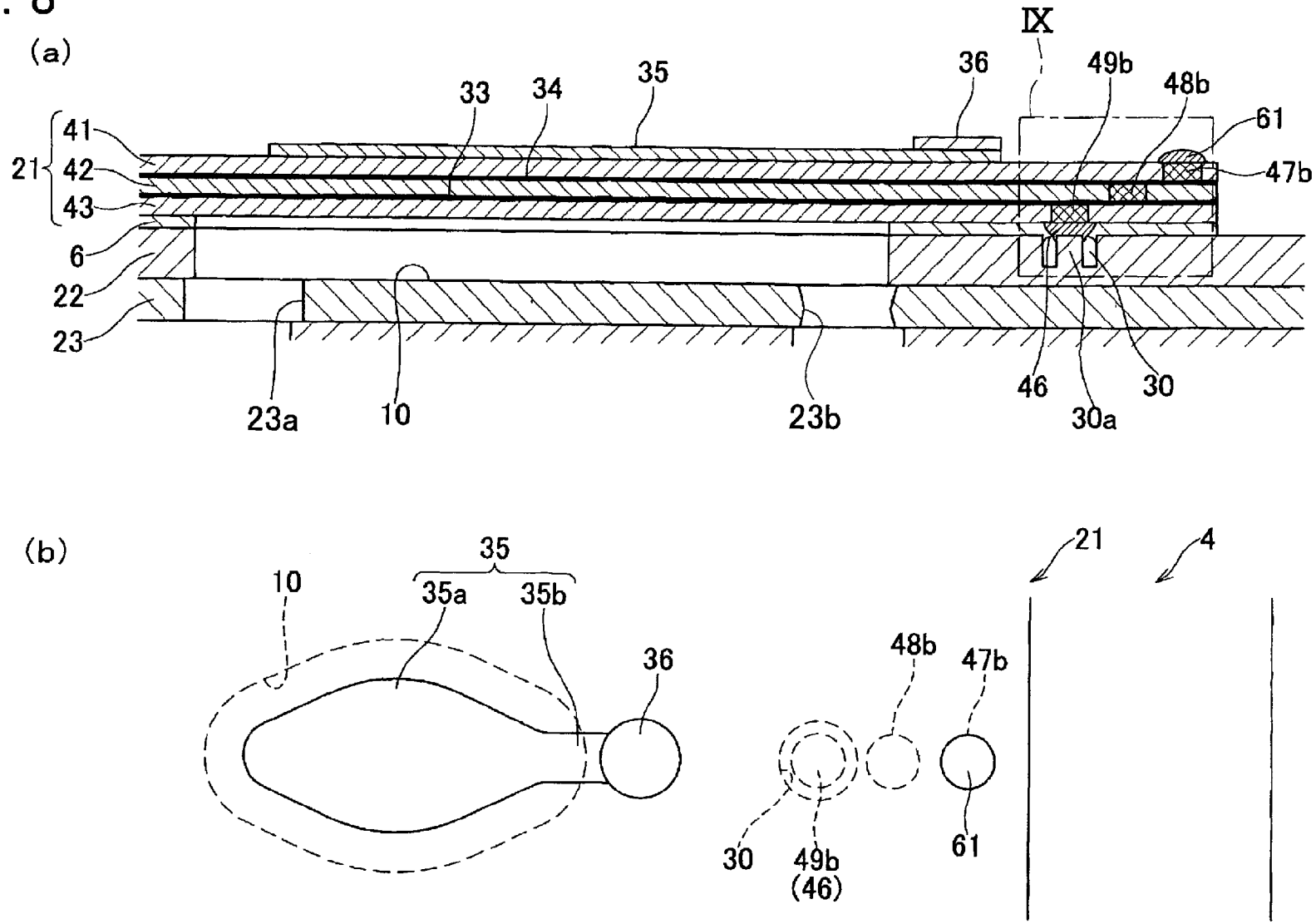
FIG. 8 (*a*) shows an expanded view of a region VIII of FIG. 6.

Next, the configuration of the actuator unit 21 will be described. FIG. 8 (*a*) shows an expanded view of a region VIII of FIG. 6. FIG. 8 (*b*) shows a plan view of the region VIII of FIG. 6.

The actuator unit 21 has three piezoelectric sheets 41, 42, and 43. The piezoelectric sheets 41, 42, and 43 are formed from lead zirconate titanate (PZT) ceramic material (an insulating material), and are ferroelectric. The thickness of each of the piezoelectric sheets 41, 42, and 43 is approximately 15 μm.

The uppermost piezoelectric sheet 41 functions as an active part that shows piezoelectric effects when an electric field is applied thereto. The remaining two piezoelectric sheets 42 and 43 do not function as active parts. The piezoelectric sheets 41, 42, and 43 are disposed so as to cover the pressure chamber group 9 (see FIG. 4 or FIG. 5).

In the present embodiment, the three piezoelectric sheets 41, 42, and 43 have a stacked configuration. Individual electrodes 35 (to be described) or the surface electrodes 61 can be disposed with a high density on an upper surface of the piezoelectric sheet 41 by using, for example, the screen printing technique. When the individual electrodes 35 can be disposed with a high density, the pressure chambers 10 can also be disposed with a high density in positions corresponding to the individual electrodes 35. High resolution printing can thus be realized.

The actuator unit 21 has a plurality of electrodes 33, 34, 35, and 61. The individual electrodes 35 and the surface electrodes 61 are disposed on the upper surface of the uppermost piezoelectric sheet 41. In FIG. 8 (*a*), only one individual electrode 35 has been shown. However, a plurality of individual electrodes 35 is actually disposed. Each individual electrode 35 is disposed at a position facing the different one pressure chamber 10. Furthermore, as shown in FIG. 5, etc. a plurality of the surface electrodes 61 is disposed on the upper surface of the piezoelectric sheet 41.

As shown in FIG. 8 (*b*), each individual electrode 35 has a main area 35*a* and an auxiliary area 35*b*. The main area 35*a* is disposed at a position facing the pressure chamber 10. The main area 35*a* has a plan shape approximately similar to the pressure chamber 10 (approximately diamond shaped). The main area 35*a* is smaller than the pressure chamber 10.

The auxiliary area 35*b* is connected with an acute angle portion of the main area 35*a*. The auxiliary area 35*b* is disposed at a position that is not facing the pressure chamber 10. A round contact 36 is formed at an anterior edge of the auxiliary area 35*b*. The contact 36 is formed from, for example, metal that contains glass flit. The contact 36 is electrically connected with the auxiliary area 35*b*.

Although this is not shown, a plurality of contacts is formed in the FPC 50 (see FIG. 2). The contact 36 of each individual electrode 35 is electrically connected with the respective contact of the FPC 50. The contacts of the FPC 50 are electrically connected with the driver IC 80 (see FIG. 2). With this structure, the driver IC 80 can individually control the electric potential of each of the individual electrodes 35.

As shown in FIG. 8 (*a*), the electrode 34, which is a common electrode, is disposed between the uppermost piezoelectric sheet 41 and the piezoelectric sheet 42 formed below the piezoelectric sheet 41. The common electrode 34 has a thickness of approximately 2 μm. The common electrode 34 has approximately the same plan shape as the piezoelectric sheets 41, etc. A front surface of the common electrode 34 (the upper surface in FIG. 8 (*a*)) makes contact with a back surface of the piezoelectric sheet 41 (the lower surface in FIG. 8 (*a*)). A back surface of the common electrode 34 makes contact with a front surface of the piezoelectric sheet 42.

The electrode 33, which is a reinforcing electrode, is disposed between the piezoelectric sheet 42 and the lowermost piezoelectric sheet 43. The reinforcing electrode 33 also has a thickness of approximately 2 μm, and has approximately the same plan shape as the piezoelectric sheets 41, etc. A front surface of the reinforcing electrode 33 makes contact with a back surface of the piezoelectric sheet 42. A back surface of the reinforcing electrode 33 makes contact with a front surface of the piezoelectric sheet 43.

The electrodes 33, 34, 35, and 61 are made from a metal material such as, for example, Ag—Pd.

Figure 9:
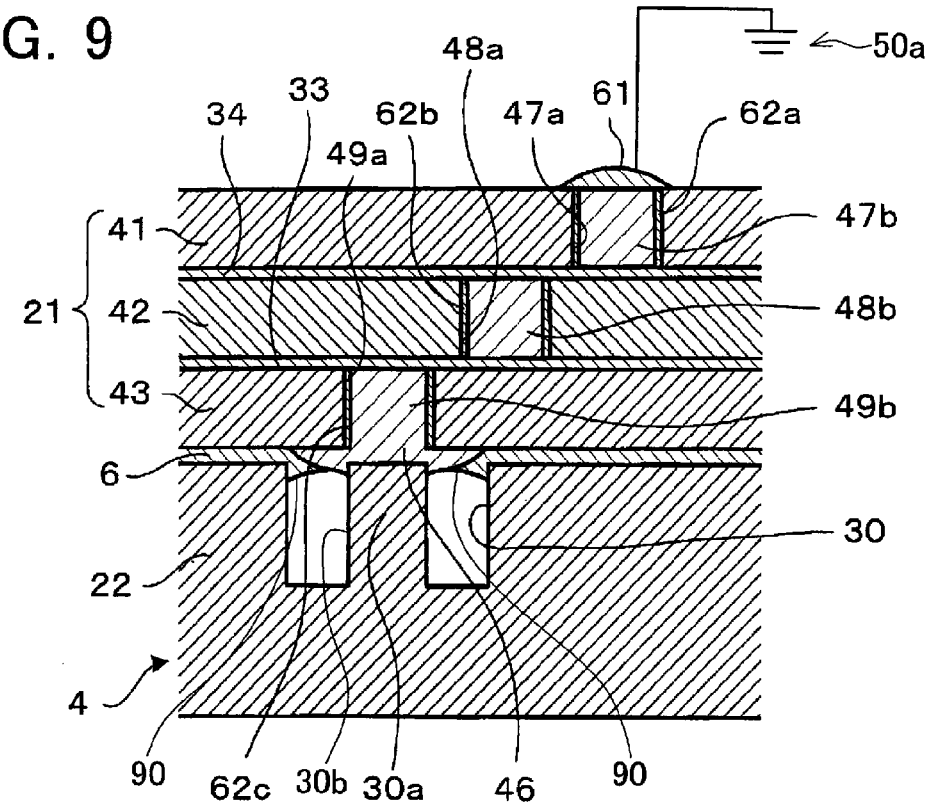
FIG. 9 shows an expanded view of a region IX of FIG. 8 (*a*).

The configuration of the actuator unit 21 will be described in more detail with reference to FIG. 9. FIG. 9 shows an expanded view of a region IX of FIG. 8 (*a*).

The piezoelectric sheet 41 has a through hole 47*a*. The through hole 47*a* is disposed at a position facing the surface electrode 61. The diameter of the surface electrode 61 is greater than the diameter of the opening of the through hole 47*a*. Although only one through hole 47*a* has been shown in FIG. 9, a plurality of through holes 47*a* is actually formed. The number of through holes 47*a* is the same as the number of surface electrodes 61 (i.e. the number of concave portions 30 of the passage unit 4 (see FIG. 5)).

The piezoelectric sheet 42 has through holes 48*a*. The number of through holes 48*a* is the same as the number of through holes 47*a*. The through holes 48*a* are formed in positions offset from the through holes 47*a*.

The piezoelectric sheet 43 has through holes 49*a*. The number of through holes 49*a* is the same as the number of through holes 47*a*. The through holes 49*a* are formed in positions offset from the through holes 47*a* and 48*a*. That is, the through holes 47*a*, 48*a*, and 49*a* are mutually offset when the ink jet head 1 is viewed from a plan view. Each through hole 49*a* is formed at a position facing the different concave portion 30. A center of the opening of the through hole 49*a* is in approximately the same position as a center of an opening of the concave portion 30 (the center of the protruding portion 30*a*).

A tubular conductive member 62*a* (a tubular member 62*a*) is disposed within the through hole 47*a*. An upper end of the tubular member 62*a* makes contact with the surface electrode 61. A lower end of the tubular member 62*a* makes contact with the front surface (the upper surface in FIG. 9) of the common electrode 34. A column shaped conductive member 47*b* (a columnar member 47*b*) is disposed within the tubular member 62*a*. The columnar member 47*b* makes contact with an inner surface of the tubular member 62*a*. An upper end of the columnar member 47*b* makes contact with the surface electrode 61, and a lower end of the columnar member 47*b* makes contact with the front surface of the common electrode 34.

A tubular conductive member 62*b* (a tubular member 62*b*) is disposed within the through hole 48*a*. An upper end of the tubular member 62*b* makes contact with a back surface (the lower surface in FIG. 9) of the common electrode 34. A lower end of the tubular member 62*b* makes contact with a front surface of the reinforcing electrode 33. A column shaped conductive member 48*b* (a columnar member 48*b*) is disposed within the tubular member 62*b*. The columnar member 48*b* makes contact with an inner surface of the tubular member 62*b*. An upper end of the columnar member 48*b* makes contact with the back surface of the common electrode 34, and a lower end of the columnar member 48*b* makes contact with the front surface of the reinforcing electrode 33.

A tubular conductive member 62*c* (a tubular member 62*c*) is disposed within the through hole 49*a*. An upper end of the tubular member 62*c* makes contact with a back surface of the reinforcing electrode 33. A lower end of the tubular member 62*c* makes contact with a columnar member 49*b* (to be described). The column shaped conductive member 49*b* (a columnar member 49*b*) is disposed within the tubular member 62*c*. The columnar member 49*b* makes contact with an inner surface of the tubular member 62*c*. An upper end of the columnar member 49*b* makes contact with the back surface of the reinforcing electrode 33. The columnar member 49*b* protrudes downwards beyond the through hole 49*a*. This protruding portion is termed a terminal 46. The terminal 46 of the columnar member 49*b* makes contact with the protruding portion 30*a*. Furthermore, the terminal 46 makes contact with the conductive adhesion layer 6.

The center of the terminal 46 of each columnar member 49*b* has a downwardly protruding shape. The terminal 46 is located at a position facing the concave portion 30 of the passage unit 4. Outer edge of the terminal 46 is located further outwards than outer edge of the through hole 49*a*. That is, from a plan view, the diameter of the terminal 46 is greater than the diameter of the through hole 49*a*. Further, the diameter of the terminal 46 is smaller than the diameter of the concave portion 30, and is greater than the diameter of the protruding portion 30*a*. A portion of the terminal 46 fits into the concave portion 30. The terminal 46 of the present embodiment is formed from Ag—Pd conductive material. This conductive material is comparatively soft. As a result, the tip of the protruding portion 30*a* easily enters the terminal 46 when the actuator unit 21 is to be bonded to the passage unit 4. That is, the terminal 46 deform along the front surface of the protruding portion 30*a*. The terminal 46 makes contact along the entire periphery of a side surface 30*b* of the protruding portion 30*a*. Since the terminal 46 and the protruding portion 30*a* make contact, the terminal 46 and the passage unit 4 make electrical contact.

A filet 90 of the conductive adhesion layer 6 is formed between the terminal 46 and an inner surface of the concave portion 30. The filet 90 of the conductive adhesion layer 6 is formed when the back surface of the actuator unit 21 (the back surface of the piezoelectric sheet 43) is bonded to the passage unit 4. Below, the manner in which the filet 90 is formed will be described.

Conductive adhesive is applied across approximately the entirety of a front surface of the passage unit 4 (the upper surface of the cavity plate 2). Then the back surface of the actuator unit 21 is pressed onto the front surface of the passage unit 4. The conductive adhesive spreads out between the passage unit 4 and the actuator unit 21. The conductive adhesive that is near the concave portions 30 spreads out such that it enters the concave portion 30. The conductive adhesive thus adheres to the terminal 46 and forms the filet 90 between the terminal 46 and the inner surface of the concave portion 30.

A first inner wiring which is configured with the tubular members 62*a*, 62*b*, and 62*c*, and a second inner wiring which is configured with the columnar members 47*b*, 48*b* and 49*b*, are aligned within the actuator unit 21. The common electrode 34 and the reinforcing electrode 33 are included in a portion of a conductive path of the first inner wiring. The common electrode 34 and the reinforcing electrode 33 are also included in a portion of a conductive path of the second inner wiring.

One end of the conductive path which is configured with the first inner wiring and the second inner wiring is connected with the surface electrode 61. The FPC 50 (see FIG. 2) has a ground potential contact 50*a*. The surface electrode 61 is soldered to the contact 50*a*. The other end of the conductive path (the terminal 46) makes contact with the protruding portion 30*a* of the passage unit 4. The terminal 46 also makes contact with the conductive adhesion layer 6. The conductive adhesion layer 6 joins with the passage unit 4. As a result, the surface electrode 61, the common electrode 34, the reinforcing electrode 33, and the passage unit 4 are all maintained at ground potential.

Next, the method of driving the actuator unit 21 will be described with reference to FIG. 8 (*a*). The uppermost piezoelectric sheet 41 functions as an active layer, and the remaining piezoelectric sheets 42 and 43 do not function as active layers. That is, in the actuator unit 21 of the present embodiment, the piezoelectric sheet 41 that is far from the pressure chambers 10 is the active layer, and the two piezoelectric sheets 42 and 43 that are close to the pressure chambers 10 are non-active layers. This type of structure is termed a unimorph type.

A direction of polarization of the piezoelectric sheet 41 is its direction of thickness. When a predetermined positive or negative potential is set for the individual electrode 35, the part of the piezoelectric sheet 41 opposite the individual electrode 35 contracts in a planar direction (a left-right direction in FIG. 8 (*a*)) due to piezoelectric effects. By contrast, the piezoelectric sheets 42 and 43 are not affected by the electric field, and consequently do not contract spontaneously. As a result, the force for making the piezoelectric sheet 41 contract in a planar direction is converted into a force for bending the piezoelectric sheets 42 and 43 in their direction of thickness. The piezoelectric sheets 41, 42, and 43 consequently deform so as to protrude downwards. This deformation is termed unimorph deformation.

When the piezoelectric sheets 41, 42, and 43 deform so as to protrude downwards, the volume of the pressure chamber 10 decreases. The pressure of the ink within the pressure chamber 10 is increased, and this ink is discharged from the nozzle 8. When the electric potential of the individual electrode 35 returns to the same electric potential as the common electrode 34, the piezoelectric sheets 41, 42, and 43 return to their original shape (the shape in FIG. 8 (*a*)). The volume of the pressure chamber 10 therefore increases, and ink is drawn into the pressure chamber 10 from the sub manifold passage 5*a*.

With the first embodiment, the terminals 46 and the protruding portions 30*a* make contact within a space that is sealed by the actuator unit 21 and the passage unit 4. Contacts between the terminals 46 and the protruding portions 30*a* are isolated from the exterior, and external force can not be applied directly to these contacts. As a result, the electrical connection between the terminals 46 and the protruding portions 30*a* is not easily severed.

In the present embodiment, the flexible columnar members 49*b* are utilized. When the protruding portions 30*a* make contact with the terminals 46 of the columnar members 49*b*, the terminals 46 deform along the front surface of the protruding portions 30*a*. The terminals 46 therefore make contact along the entire side surface 30*b* of the protruding portions 30*a*. Since there is a greater area of contact between the terminals 46 and the protruding portions 30*a*, the electrical connection between these is made more reliable.

Furthermore, the depth of the concave portions 30 is the same as the height of the protruding portions 30*a*. As a result, the terminals 46 and the protruding portions 30*a* make contact reliably.

For example, in the case where the adhesive is applied to the upper surface of the passage unit 4, the adhesive may adhere to the upper surface of the protruding portions 30*a*. In the present embodiment, the terminals 46 make contact with the side surfaces 30*b* of the protruding portions 30*a*. In this case, the terminals 46 do not necessarily need to make contact with the upper surface of the protruding portions 30*a*. As a result, if the adhesive has adhered to the upper surfaces of the protruding portions 30*a*, a task of removing the adhesive from the protruding portions 30*a* need not be performed. Removing the adhesive creates extremely small debris that could block the nozzles 8. Since the task of removing the adhesive is not needed in the present embodiment, it is possible to prevent the nozzles 8 from being blocked.

Further, each concave portion 30 has a ring shape due to the protruding portion 30*a*. As a result, the terminal 46 readily spreads within the concave portion 30 when the terminal 46 makes contact with the protruding portion 30*a*. Moreover, the diameter of the through hole 49*a* is smaller than the diameter of the concave portion 30. As a result, even though the terminal 46 deform along the front surface of the protruding portion 30*a*, the terminal 46 can be prevented from extending beyond the concave portion 30. Furthermore, the diameter of the through hole 49*a* is greater than the diameter of the protruding portion 30*a*. As a result, the protruding portion 30*a* can easily enter the terminal 46.

The plurality of terminals 46 (the plurality of concave portions 30) is disposed so as to surround the pressure chamber group 9. Since it is not necessary to dispose the terminals 46 or the concave portions 30 between the pressure chambers 10, the pressure chambers 10 can be disposed with a high density.

In the present embodiment, a plurality of the surface electrodes 61 is distributed at a plurality of locations, and each surface electrode 61 is electrically connected with the common electrode 34. Since the plurality of surface electrodes 61 is electrically connected with the common electrode 34, the common electrode 34 can reliably be maintained at ground potential.

Further, a plurality of the terminals 46 is provided, and each terminal 46 is connected with one of the protruding portions 30*a* and the conductive adhesion layer 6. As a result, there is a reliable electrical connection between the terminals 46 and the passage unit 4.

The through holes 47*a*, 48*a*, and 49*a* are mutually offset. As a result, the members housed in the through holes 47*a*, 48*a*, and 49*a* can be prevented from interfering with one another. For example, if the through holes 47*a*, 48*a*, and 49*a* were formed at the same position and force were applied to the surface electrode 61 when the FPC 50 is being joined to the surface electrode 61, this force could be applied to the columnar member 49*b* via the columnar members 47*b* and 48*b*. In this case, the columnar member 49*b* might come out of the through hole 49*a*. When the through holes 47*a*, 48*a*, and 49*a* are offset, as in the present embodiment, this phenomenon can be prevented.

In the present embodiment, the conductive path from the surface electrode 61 to the common electrode 34 is formed within the actuator unit 21. Further, the conductive path from the common electrode 34 to the reinforcing electrode 33 is formed within the actuator unit 21. The conductive path from the common electrode 34 to the passage unit 4 is formed within the ink jet head 1. That is, in the present embodiment, the entire path of the conductive path from the surface electrode 61 to the passage unit 4 is formed within the ink jet head 1. As a result, it is possible to prevent external force from being applied directly to the conductive path. The electrical connection between the surface electrode 61, the common electrode 34, the reinforcing electrode 33, and the passage unit 4 is extremely stable.

Variant of the First Embodiment

Figure 10:
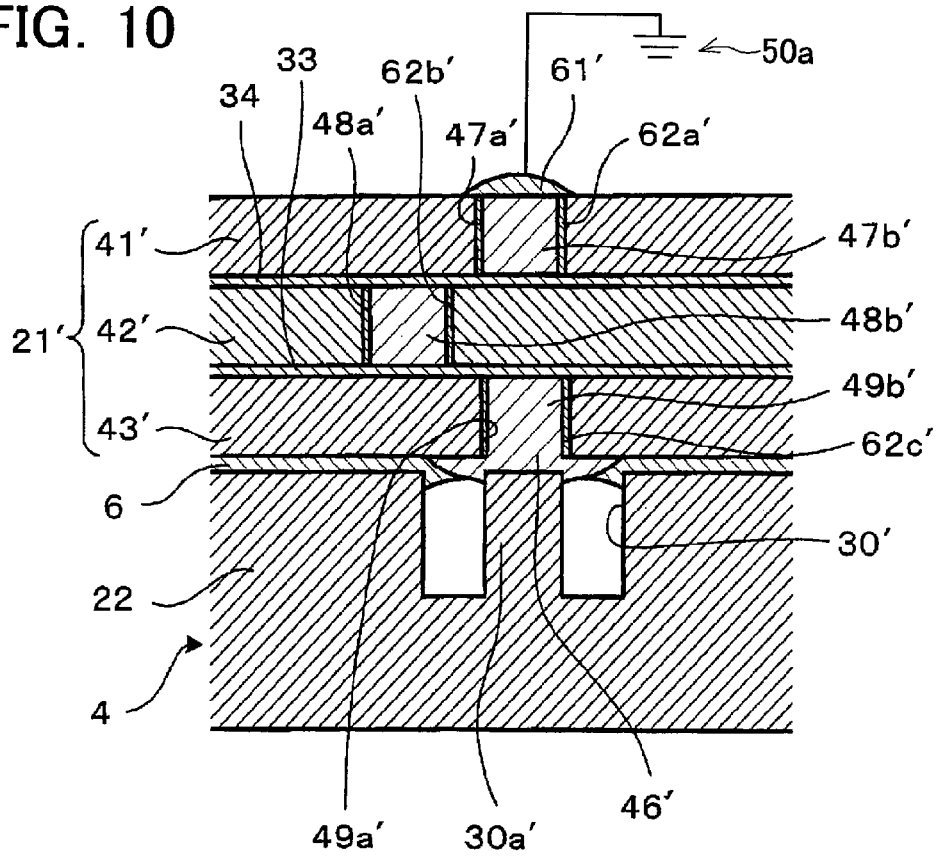
FIG. 10 shows a view for describing a variant of the first embodiment.

A variant of the first embodiment will now be described. FIG. 10 shows a view for describing the present variant. An actuator unit is represented by 21'. Piezoelectric sheets are represented by 41', 42', and 43'. Through holes are represented by 47*a*', 48*a*', and 49*a*'. Columnar members are represented by 47*b*', 48*b*', and 49*b*'. Tubular members are represented by 62*a*', 62*b*', and 62*c'*.

From a plan view, the through hole 48*a*' is offset from the through holes 47*a*' and 49*a*'. As a result, force applied to surface electrode 61' is not transmitted to the columnar member 49*b*'. Furthermore, the through holes 47*a*' and 49*a*' are formed at the same position. As a result, the planar area occupied by the through holes 47*a*', 48*a*', and 49*a*' (the width in the left-right direction) can be smaller than with the configuration of FIG. 9. Furthermore, when the operation of connecting the FPC 50 to the surface electrode 61' is executed after the operation of connecting the passage unit 4 with the actuator unit 21 has been performed, the force applied to the surface electrode 61' is transmitted to the periphery of the concave portion 30 directly below the surface electrode 61'. In this case, the filet can easily be formed at the conductive adhesion layer 6. This result can be obtained by overlapping (from a plan view) at least a portion of the surface electrode 61' with the concave member 30.

Second Embodiment

Figure 11:
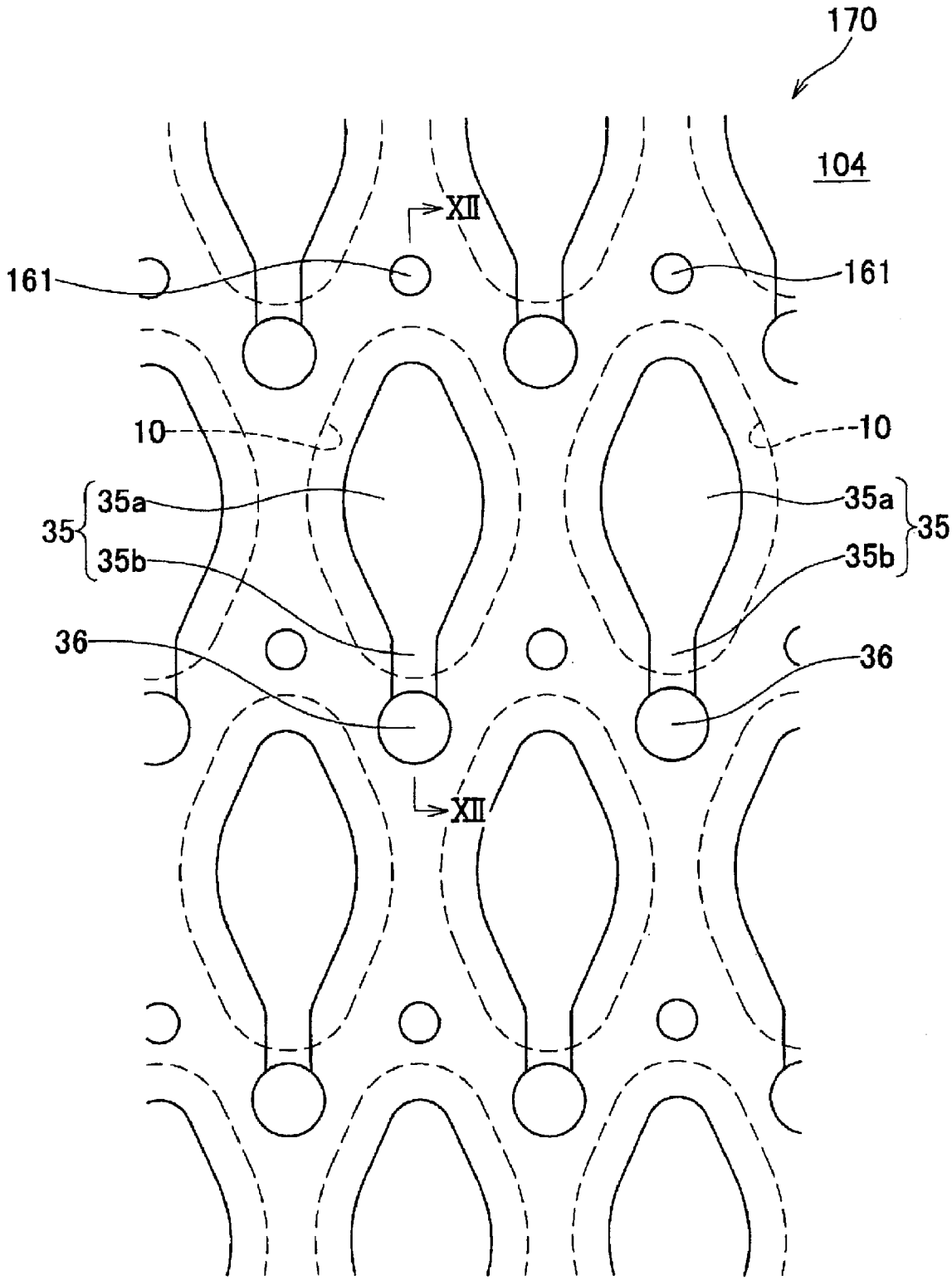
FIG. 11 shows a plan view of a part of an actuator unit of a second embodiment.
Figure 12:
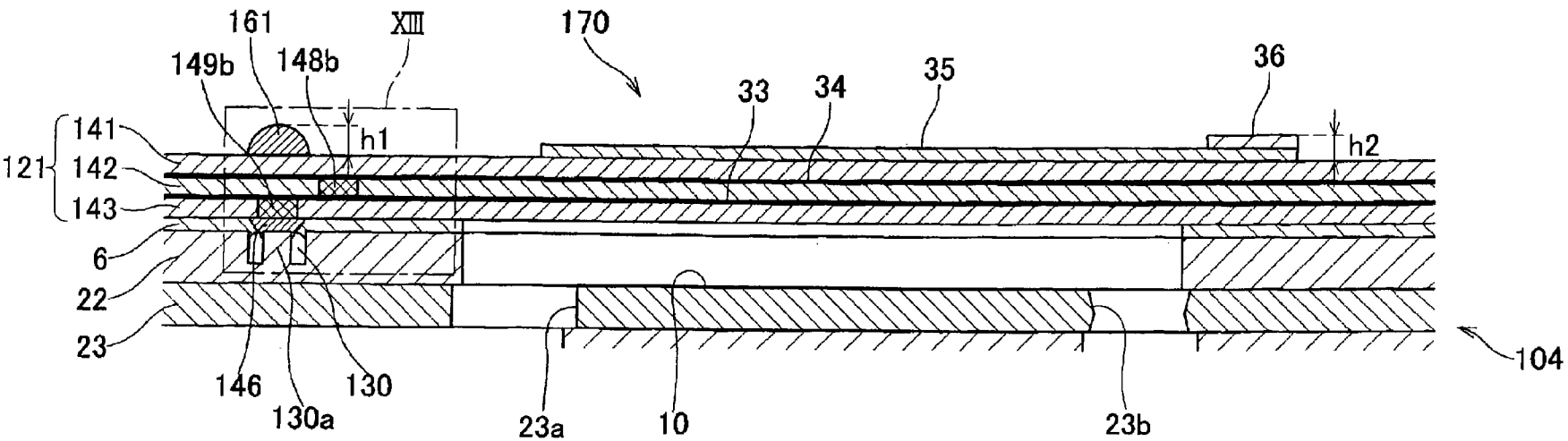
FIG. 12 shows a cross-sectional view along the line XII-XII of FIG. 11.

An ink jet head of a second embodiment will now be described. FIG. 11 shows a plan view of a part of a head main body 170 of the second embodiment. In FIG. 11, the pressure chambers 10 are shown by broken lines. FIG. 12 shows a cross-sectional view along the line XII-XII of FIG. 11.

As shown in FIG. 12, the head main body 170 includes a passage unit 104 in which an ink passage is formed, and an actuator unit 121 stacked on the passage unit 104. A front surface of the passage unit 104 and a back surface of the actuator unit 121 are bonded together by means of the conductive adhesion layer 6.

As shown in FIG. 11, the actuator unit 121 has a plurality of individual electrodes 35 that is substantially diamond shaped. The individual electrodes 35 are aligned in a matrix shape. Each individual electrode 35 is disposed at a position facing a different one of the pressure chambers 10. One individual electrode 35 is smaller than one pressure chamber 10. A contact 36 is formed at an auxiliary area 35*b* of the individual electrode 35.

In the present embodiment, the surface electrodes 61 of the first embodiment are not present. The actuator unit 121 comprises a plurality of surface members 161. The surface members 161 are formed at the upper surface of the uppermost piezoelectric sheet 41. One surface member 161 is formed for each individual electrode 35. One surface member 161 is disposed between the auxiliary areas 35*b* of two individual electrodes 35 that are adjacent in the left-right direction of FIG. 11. The surface members 161 may be formed from conductive material, or may be formed from isolating material. Each surface member 161 has a circular shape.

When viewing one pressure chamber 10, one contact 36 is formed near a vertex of one acute angle of the diamond shape, and a surface member 161 is formed near a vertex of the other acute angle thereof. In the present embodiment, one pressure chamber 10 could be said to be surrounded by a hexagon in which three contacts 36 and three surface members 161 form the vertices. Further, one pressure chamber 10 could be said to be surrounded by a triangle in which three surface members 161 form the vertices.

As shown in FIG. 12, the passage unit 104 has substantially the same configuration as the passage unit 4 of the first embodiment. However, the configuration of a cavity plate 122 differs somewhat from the configuration of the cavity plate 22 of the first embodiment. In the present embodiment, the position of concave portions 130 of the cavity plate 122 differs from the first embodiment. Each of the concave portions 130 is formed in a position corresponding to the position of one of the surface members 161.

A protruding portion 130*a* that extends toward the actuator unit 121 is formed at a bottom surface of each concave portion 130. From a plan view, the concave portion 130 is ring shaped. Further, the depth of the concave portion 130 is equal to the height of the protruding portion 130*a*. An upper surface of the protruding portion 130*a* and an upper surface of the passage unit 104 are located in the same plane.

The actuator unit 121 of the present embodiment also has three piezoelectric sheets 141, 142, and 143. The plurality of individual electrodes 35 and the plurality of surface members 161 are disposed at a front surface (the upper surface in FIG. 12) of the uppermost piezoelectric sheet 141. The common electrode 34 is disposed between the uppermost piezoelectric sheet 141 and the piezoelectric sheet 142 disposed under the piezoelectric sheet 141. Further, the reinforcing electrode 33 is disposed between the piezoelectric sheet 142 and the lowermost piezoelectric sheet 143.

In the present embodiment, through holes are not formed in the piezoelectric sheet 141. The surface members 161 and the common electrode 34 are not electrically connected.

Moreover, a height h1 of the surface members 161 is substantially equal to a total height h2 that is the sum of the height of the individual electrode 35 and the height of the contact 36.

Figure 13:
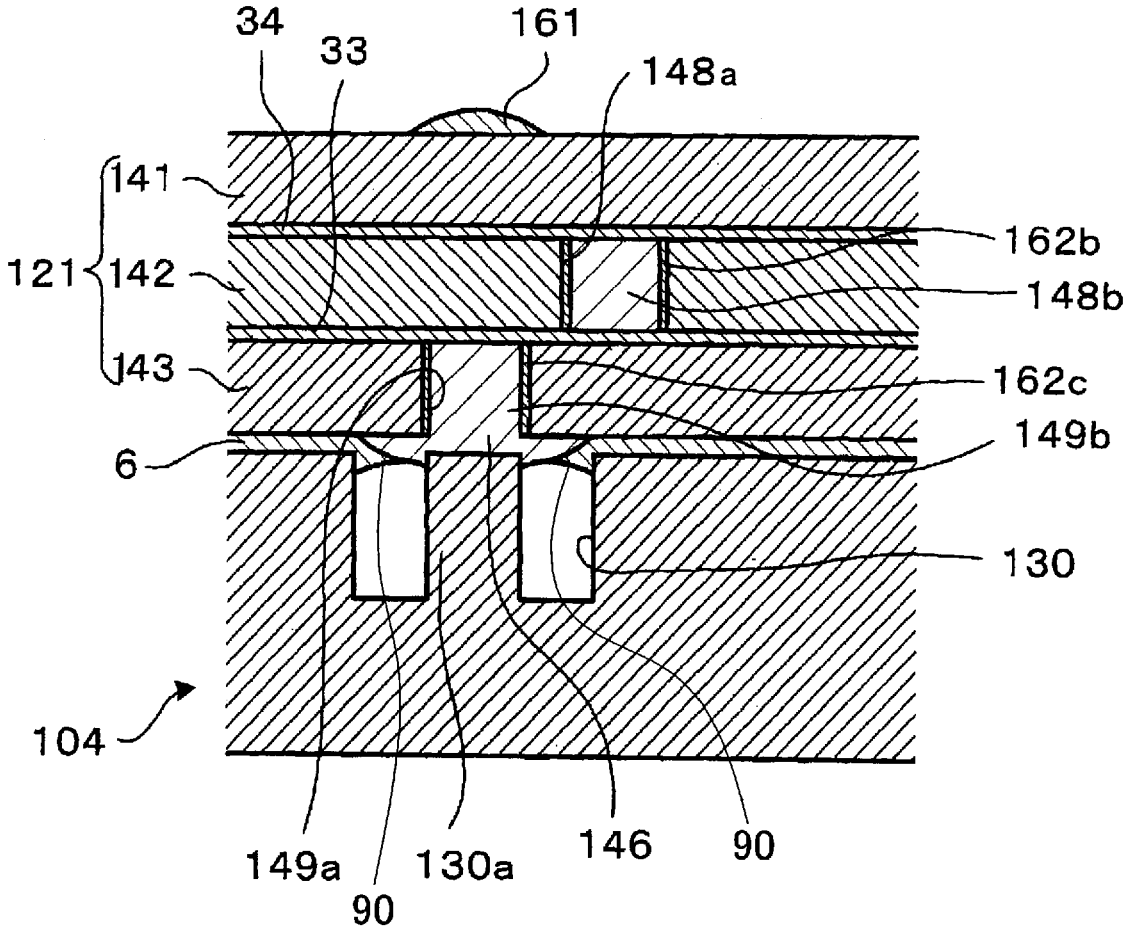
FIG. 13 shows an expanded view of a region XIII of FIG. 12.

FIG. 13 shows an expanded view of a region XIII of FIG. 12. The piezoelectric sheet 142 has through holes 148*a*. The number of through holes 148*a* is the same as the number of surface members 161 (the number of concave portions 130). The piezoelectric sheet 143 has through holes 149*a*. The number of through holes 149*a* is the same as the number of through holes 148*a*. The through holes 148*a* and the through holes 149*a* are mutually offset. One concave portion 130 is located opposite one through hole 149*a*. A center of each through hole 149*a* is formed in the same location as a center of each concave portion 130. Further, the diameter of the concave portion 130 is greater than the diameter of the through hole 149*a*. The diameter of the protruding portion 130*a* is smaller than the diameter of the through hole 149*a*.

A conductive tubular member 162*b* is disposed within the through hole 148*a*. An upper end of the tubular member 162*b* makes contact with a back surface of the common electrode 34. A lower end of the tubular member 162*b* makes contact with a front surface of the reinforcing electrode 33. A conductive columnar member 148*b* is disposed within the tubular member 162*b*. An upper end of the columnar member 148*b* makes contact with the back surface of the common electrode 34, and a lower end of the columnar member 148*b* makes contact with the front surface of the reinforcing electrode 33.

A conductive tubular member 162*c* is disposed within the through hole 149*a*. An upper end of the tubular member 162*c* makes contact with a back surface of the reinforcing electrode 33. A lower end of the tubular member 162*c* makes contact with a columnar member 149*b* (to be described). The conductive columnar member 149*b* is disposed within the tubular member 162*c*. An upper end of the columnar member 149*b* makes contact with the back surface of the reinforcing electrode 33. The columnar member 149*b* protrudes downwards beyond the through hole 149*a*. This protruding portion is termed a terminal 146. The terminal 146 of the columnar member 149*b* makes contact with the protruding portion 130*a*. Furthermore, the terminal 146 makes contact with the conductive adhesion layer 6.

From a plan view, the surface members 161 and the terminals 146 are disposed at the same location. As a result, three terminals 146 surround one pressure chamber 10. The surface members 161 are terminals opposing the terminals 146.

A third inner wiring which is configured with the tubular members 162*b* and 162*c*, and a fourth inner wiring which is configured with the columnar members 148*b* and 149*b*, are aligned within the actuator unit 121. The common electrode 34 and the reinforcing electrode 33 are included in a portion of a conductive path of the third inner wiring. The common electrode 34 and the reinforcing electrode 33 are also included in a portion of a conductive path of the fourth inner wring.

The common electrode 34 is earthed at a location that is not shown. For example, the common electrode 34 is exposed at a side surface of the actuator unit 121. This exposed portion is connected with ground potential. The common electrode 34, the reinforcing electrode 33, and the passage unit 104 are all maintained at ground potential. That is, a configuration is formed in which there is no potential difference between the passage unit 104 and the common electrode 34 (the reinforcing electrode 33).

The surface members 161 are electrically insulated from the conductive paths and the individual electrodes 35.

In the present embodiment, the surface members 161, the terminals 146, and the protruding portions 130*a* have the same positional relationship from a plan view. As a result, if a downwards pushing force is applied to the surface members 161 when the passage unit 104 and the actuator unit 121 are to be bonded together, this force is transmitted effectively to the terminals 146. The terminals 146 and the protruding portions 130*a* can therefore be made to make contact strongly with one another. Furthermore, it is easy to form the filet 90 of the conductive adhesion layer 6.

Further, since the height of the surface members 161 is substantially equal to the height of the contacts 36, the following effect is obtained. When the passage unit 104 and the actuator unit 121 are to be bonded together, the actuator unit 121 may be pressed toward the passage unit 104 by a plate shaped member. When the surface members 161 and the contacts 36 have the same height, uniform force can be applied to the surface members 161 and the contacts 36. As a result, it is possible to apply uniform force to all the parts of the actuator unit 121. The passage unit 104 and the actuator unit 121 can therefore be bonded together well.

Third Embodiment

Figure 14:
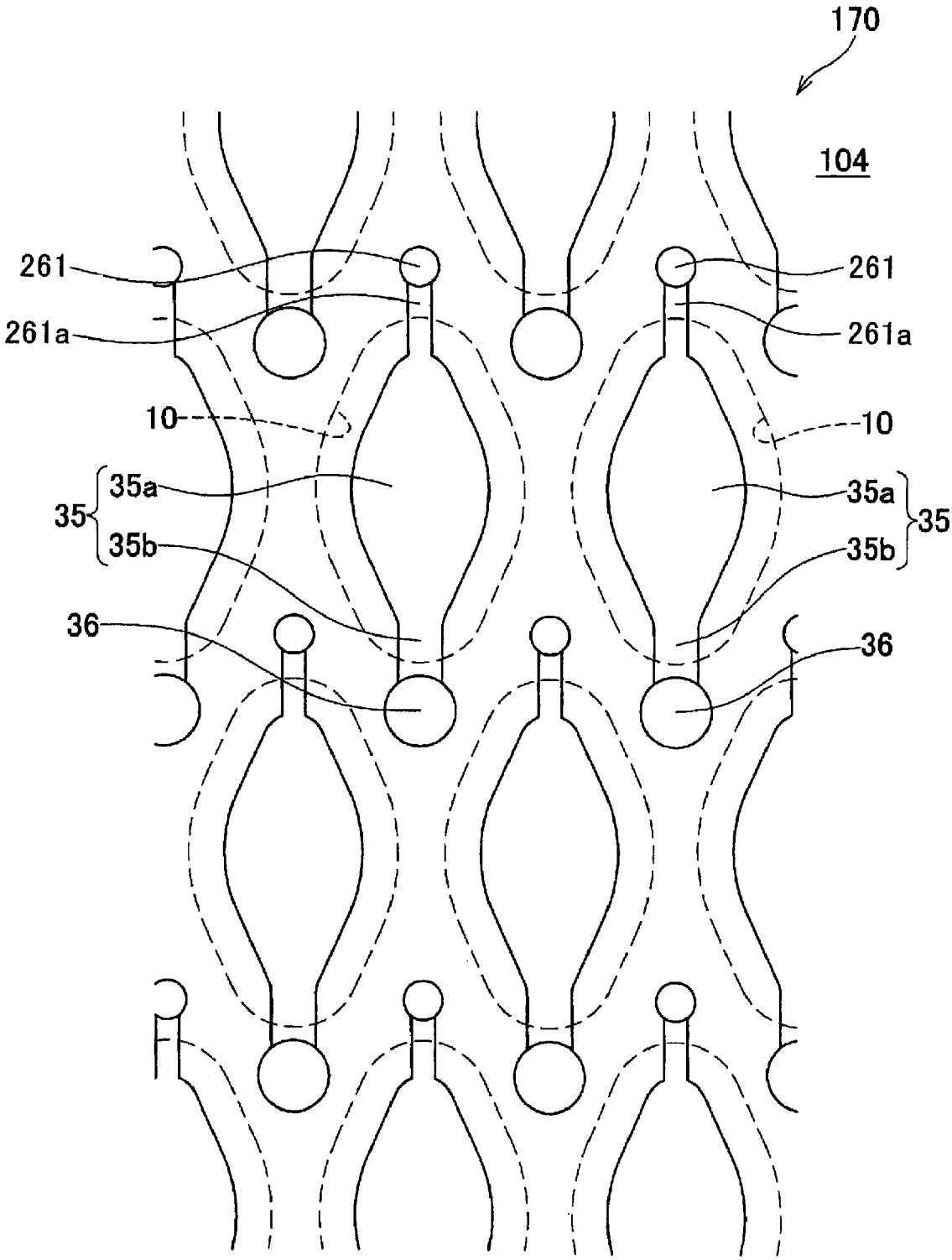
FIG. 14 shows a cross-sectional view of a part of a head main body of a third embodiment.

FIG. 14 shows a plan view of a part of a head main body 170 of a third embodiment. In the present embodiment, points differing from the second embodiment will be described.

Surface members 261 are conductive. Each surface member 261 is electrically connected with a different individual electrode 35 via a wiring 261*a*.

The FPC 50 has a plurality of sets of a first contact and a second contact (not shown). The number of these sets is the same as the number of individual electrodes 35. The first contact of one set is electrically connected with one of the individual electrodes 35. The second contact of this set is electrically connected with the surface member 261 of the same individual electrode 35.

With the configuration of the present embodiment, there are two connecting paths between one individual electrode 35 and the FPC 50. The electrical connection between the individual electrode 35 and the FPC 50 is therefore stable. Further, since there is an increase in the connecting paths between the actuator unit 121 and the FPC 50, it is possible to increase mechanical joining strength between the two.

Variants of the above embodiments will now be given.

(1) In the aforementioned embodiments, the height of the protruding portion 30*a* (130*a*) was equal to the depth of the concave portion 30 (130). However, the height of the protruding portion 30*a* (130*a*) may be less than the depth of the concave portion 30 (130). In this case, it is preferred that the protruding portion 30*a* (130*a*) has a height allowing it to make contact with the terminal 46 (146).

Further, the height of the protruding portion 30*a* (130*a*) may be greater than the depth of the concave portion 30 (130).

(2) The shape of the concave portion 30 (130) and the protruding portion 30*a* (130*a*) is not restricted to the shape in the present embodiments. For example, either or both the concave portion 30 (130) and the protruding portion 30*a* (130*a*) may have an angular columnar shape. Further, the protruding portion 30*a* (130*a*) may protrude from a side surface of the concave portion 30 (130). In this case, also, it is preferred that the protruding portion 30*a* (130*a*) extends toward the actuator unit 21 (121).

(3) In the first embodiment, the pressure chamber group 9 was surrounded by the plurality of terminals 46. However, the pressure chamber group 9 may equally well not be surrounded by the plurality of terminals 46. Only one terminal 46 may be utilized rather than the plurality of terminals 46. That is, there may equally well be only one conductive path formed from the passage unit 4 to the surface electrodes 61.

(4) The following method may be adopted as the method for driving the actuator unit 21. The individual electrode 35 and the common electrode 34 have a different electric potential while ink is not being discharged. In this case, the piezoelectric sheets 41, 42, and 43 protrude downwards, and the volume of the pressure chamber 10 is smaller. When the ink is to be discharged, the individual electrode 35 is made to have the same electric potential as the common electrode 34. The state in which the piezoelectric sheets 41, 42, and 43 protrude downwards is thus released, and the volume of the pressure chamber 10 increases. The ink is drawn into the pressure chamber 10. Then, with a predetermined timing, the individual electrode 35 is made to have a different electric potential from the common electrode 34. The piezoelectric sheets 41, 42, and 43 protrude downwards, and the pressure of the ink within the pressure chamber 10 is increased. The ink is thus discharged from the nozzle 8.

(5) In the above embodiments, the columnar members 47*b*, 48*b*, 49*b*, 148*b*, and 149*b* extend in the direction of thickness of the piezoelectric sheets 41, 42, and 43. However, at least one of the columnar members 47*b*, 48*b*, 49*b*, 148*b*, and 149*b* may equally well extend in a direction other than the direction of thickness of the piezoelectric sheets 41, 42, and 43.

(6) The terminals 46 (146) may equally well not have a configuration in which the center thereof protrudes downwards. For example, a central part of the terminals 46 (146) may have a concave shape.

Furthermore, the entirety of the outer edge of the terminal 46 (146) was located further outwards than the through hole 49*a*. However, this configuration may equally well not be adopted. For example, the terminal 46 (146) may have a configuration in which only a portion of the outer edge is located further outwards than the through hole 49*a*. As another example, the terminal 46 (146) may have a configuration in which the entirety of the outer edge of the terminal 46 (146) is located inwards from the through hole 49*a*.

(7) In the above embodiments, the tubular member (for example 62*a*) and the columnar member (for example 47*b*) were disposed within the through hole (for example 47*a*). However, the tubular member does not necessarily need to be provided, and only the columnar member may be provided.

(8) In the second embodiment, the surface members 161 may be electrically isolated from the individual electrodes 35, and may be electrically connected with the terminals 146. In this case, there is an increase in positions where the FPC 50 and the actuator unit 121 connect, and consequently it is possible to increase mechanical joining strength between the two.

(9) In the first embodiment, the surface electrodes 61 may equally well not be provided. In this case, the common electrode 34 may equally well be grounded via another path. Further, in the second embodiment, the surface members 161 may equally well not be provided.

(10) A material that hardens when a process other than a heating process is performed can be utilized for the columnar members 47*b*, 48*b*, 49*b*, 148*b*, and 149*b*. Further, a material that does not harden if a heating process, etc. is performed may equally be utilized.

(11) The terminals 46 (146) may make contact only with the upper surface of the protruding portions 30*a* (130*a*). That is, the terminals 46 (146) may equally well not make contact with the side surfaces 30*b* of the protruding portions 30*a* (130*a*).

Furthermore, in the case where the terminals 46 (146) do make contact with the side surfaces of the protruding portions 30*a* (130*a*), the terminals 46 (146) may equally well not make contact with the entire side surface of the protruding portions 30*a* (130*a*).

What is claimed is:

1. An ink jet head, comprising:

a passage unit comprising a nozzle and a pressure chamber communicating with the nozzle; and an actuator unit comprising a piezoelectric layer, a first electrode connected with a front surface of the piezoelectric layer, a second electrode connected with a back surface of the piezoelectric layer, a first insulating layer located between the second electrode and the passage unit, and a first conductive member, the first insulating layer comprising a first through hole, at least a part of the first conductive member located in the first through hole;

wherein the passage unit comprises a concave portion located at a position facing the first through hole, and a protruding portion which protrudes from an inner surface of the concave portion, one end of the first conductive member is electrically connected with the second electrode, and the other end of the first conductive member makes contact with the protruding portion.

2. The ink jet head as in claim 1, wherein the first conductive member protrudes from the first through hole toward the passage unit.

3. The ink jet head as in claim 1, wherein the protruding portion protrudes from a bottom surface of the concave portion.

4. The ink jet head as in claim 3, wherein the depth of the concave portion is substantially equal to the height of the protruding portion.

5. The ink jet head as in claim 3, wherein from the plan view of the ink jet head, the concave portion has a ring shape.

6. The ink jet head as in claim 5, wherein the first conductive member makes contact with a side surface of the protruding portion.

7. The ink jet head as in claim 6, wherein the protruding portion proceeds into the first conductive member, and the first conductive member makes contact with the all circumferences of the side surface of the protruding portion.

8. The ink jet head as in claim 7, wherein the diameter of the concave portion is greater than the diameter of the first through hole, and the diameter of the first through hole is greater than the diameter of the protruding portion.

9. The ink jet head as in claim 1, further comprising:

an adhesion layer adhering to both a front surface of the passage unit and a back surface of the first insulating layer.

10. The ink jet head as in claim 9, wherein the adhesion layer is a conductive adhesion layer, and the first conductive member makes contact with both the protruding portion and the adhesion layer.

11. The ink jet head as in claim 1, wherein the actuator unit comprises a plurality of first conductive members, the first insulating layer comprises a plurality of first through holes, each first conductive member is located in a different one of the first through holes, the passage unit comprises a plurality of concave portions and a plurality of protruding portions, each concave portion is located at a position facing a different one of the first through holes, each protruding portion protrudes from an inner surface of a different one of the concave portions, one end of each first conductive member is electrically connected with the second electrode, and the other end of each first conductive member makes contact with a different one of the protruding portions.

12. The ink jet head as in claim 11, wherein the passage unit comprises a plurality of nozzles and a plurality of pressure chambers, each pressure chamber communicates with a different one of the nozzles, and from the plan view of the ink jet head, the pressure chambers are surrounded by the first conductive members.

13. The ink jet head as in claim 1, wherein the actuator unit further comprises a second insulating layer located between the second electrode and the first insulating layer, and a second conductive member, the second insulating layer comprises a second through hole, at least a part of the second conductive member is located in the second through hole, one end of the second conductive member is electrically connected with the second electrode, and the other end of the second conductive member is electrically connected with the one end of the first conductive member.

14. The ink jet head as in claim 13, wherein the actuator unit further comprises a conductive layer located between the first insulating layer and the second insulating layer, the one end of the second conductive member makes contact with the second electrode, the other end of the second conductive member makes contact with the conductive layer, and the one end of the first conductive member makes contact with the conductive layer.

15. The ink jet head as in claim 1, wherein the actuator unit further comprises a first surface member connected with the front surface of the piezoelectric layer, the first surface member is conductive, and the first surface member is electrically connected with the second electrode.

16. The ink jet head as in claim 15, wherein the actuator unit comprises a plurality of first surface members, and each first surface member is electrically connected with the second electrode.

17. The ink jet head as in claim 15, wherein the actuator unit further comprises a third conductive member, the piezoelectric layer comprises a third through hole, at least a part of the third conductive member is located in the third through hole, one end of the third conductive member is electrically connected with the first surface member, and the other end of the third conductive member is electrically connected with the second electrode.

18. The ink jet head as in claim 17, wherein the first surface member is located at a position facing the third through hole, the one end of the third conductive member makes contact with the first surface member, and the other end of the third conductive member makes contact with the second electrode.

19. The ink jet head as in claim 1, wherein the actuator unit further comprises a second surface member connected with the front surface of the piezoelectric layer, and from the plan view of the ink jet head, the second surface member is located at a position corresponding to the first conductive member.

20. The ink jet head as in claim 19, wherein the actuator unit further comprises a contact connected with a front surface of the first electrode, and the height of the second surface member is substantially equal to the sum of the height of the first electrode and the height of the contact.

21. The ink jet head as in claim 1, wherein the actuator unit further comprises a third surface member connected with the front surface of the piezoelectric layer, the third surface member is conductive, and the third surface member is electrically connected with the first electrode.

* * * * *